US006196717B1

(12) United States Patent
Belias et al.

(10) Patent No.: US 6,196,717 B1
(45) **Date of Patent: *Mar. 6, 2001**

(54) FOLDED THERMOPLASTIC BAG STRUCTURE

(75) Inventors: William P. Belias, Pittsford; Robert T. Maddock, Ionia, both of NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/515,140

(22) Filed: Feb. 29, 2000

Related U.S. Application Data

(62) Division of application No. 09/049,402, filed on Mar. 27, 1998, now Pat. No. 6,059,707.

(51) Int. Cl.[7] ..... B65D 33/10
(52) U.S. Cl. ..... 383/37; 383/8
(58) Field of Search ..... 383/8, 37; 206/390, 206/554

(56) References Cited

U.S. PATENT DOCUMENTS

| | | |
|---|---|---|
| Re. 33,264 | 7/1990 | Baxley et al. . |
| 209,749 | 11/1878 | Brown . |
| 277,153 | 5/1883 | Onderdonk . |
| D. 297,113 | 8/1988 | Beniot . |
| D. 302,112 | 7/1989 | Beniot . |
| 328,888 | 10/1885 | Hunt . |
| 341,720 | 5/1886 | Bayle . |
| 447,686 | 3/1891 | Holladay . |
| 558,291 | 4/1896 | Lunham . |
| 769,295 | 9/1904 | Beltz . |
| 868,504 | 10/1907 | Taylor . |
| 1,403,751 | 1/1922 | Edstrom . |
| 1,424,690 | 8/1922 | Syers . |
| 1,453,200 | 4/1923 | Stacho . |
| 1,663,391 | 3/1928 | Shaffer et al. . |
| 1,679,450 | 8/1928 | Thompson . |
| 1,799,537 | 4/1931 | Schindler . |

(List continued on next page.)

FOREIGN PATENT DOCUMENTS 0 541 028 * 5/1993 (EP) ..... 383/37

*Primary Examiner*—Jes F. Pascua
(74) *Attorney, Agent, or Firm*—Jenkens & Gilchrist

(57) ABSTRACT

A method of forming a plurality of easy to open handle bags including the steps of providing a flattened tube of thermoplastic material oriented in a generally longitudinal direction. The flattened tube has a first longitudinal side edge and a second longitudinal side edge, a transverse lower heat seal, and a transverse upper heat seal. The tube also has first, second, and third sections. The second section being disposed between the first and third sections. The first section is joined to the second section along a generally longitudinal first fold line. The second section is joined to the third section along a generally longitudinal second fold line. The second section is cut along a generally transverse first cut line extending between the first and second fold lines. The first section is folded over the second section along the first fold line. The third section is folded over the previously folded-over first section along the second fold line such that the first, second, and third sections overlap one another. The overlapped first, second, and third sections are cut along a generally longitudinal second cut line that intersects the first cut line, the first fold line, and the second side edge at one end and intersects the upper heat seal at the other end. The overlapped first, second, and third sections are then cut along a generally longitudinal third cut line that intersects the first cut line, the second fold line, and the first side edge at one end and intersects the upper heat seal at the other end.

16 Claims, 5 Drawing Sheets

U.S. PATENT DOCUMENTS 1,971,642 8/1934 Champlin .
2,071,362 2/1937 Rowe .
2,095,067 10/1937 Kirk .
2,126,203 8/1938 Miskella .
2,162,113 6/1939 Noffsinger .
2,170,945 8/1939 Greene .
2,294,220 8/1942 Albertson .
2,320,326 5/1943 Avery .
2,412,066 12/1946 Shear .
2,432,122 12/1947 Pardee .
2,648,512 8/1953 Scholin .
2,673,024 3/1954 Kuss .
2,689,594 9/1954 Wendt .
2,815,186 12/1957 Miller .
2,819,834 1/1958 Brady .
2,871,771 2/1959 Mercer .
2,915,098 12/1959 McKay .
3,048,069 8/1962 Berlin et al. .
3,064,652 11/1962 Corcoran et al. .
3,111,677 11/1963 Artzt .
3,119,548 1/1964 Cook et al. .
3,125,281 3/1964 Woolen .
3,125,548 3/1964 Anderson .
3,133,691 5/1964 Corbett .
3,142,437 7/1964 Grant et al. .
3,143,277 8/1964 LaFleur .
3,154,238 10/1964 Barnhill .
3,176,052 3/1965 Peticolas .
3,180,557 4/1965 Thulin .
3,204,760 9/1965 Whiteford .
3,204,817 9/1965 Kostering .
3,226,070 12/1965 Kurlander .
3,254,828 6/1966 Lerner .
3,256,764 6/1966 Hardy .
3,276,670 10/1966 Harvey .
3,317,037 5/1967 Russell .
3,320,843 5/1967 Schott, Jr. .
3,349,991 10/1967 Kessler .
3,352,411 11/1967 Schwarzkopf .
3,378,189 4/1968 Dickson .
3,380,579 4/1968 Pinto .
3,381,886 5/1968 Goglio .
3,454,441 7/1969 Spruyt .
3,463,470 8/1969 Green et al. .
3,468,470 9/1969 Sengewald .
3,482,761 * 12/1969 Suominen et al. ..... 383/8
3,485,437 12/1969 Gruentzel et al. .
3,485,439 12/1969 Shrum .
3,509,116 4/1970 Cote et al. .
3,533,331 10/1970 Kugler .
3,548,723 12/1970 Sengewald .
3,549,451 12/1970 Kugler .
3,552,697 1/1971 Pinto .
3,580,486 5/1971 Kugler .
3,587,382 6/1971 Boyd .
3,587,844 6/1971 Wing .
3,593,622 7/1971 Sengewald .
3,601,925 8/1971 Bolling .
3,607,521 9/1971 Suominen .
3,607,534 9/1971 Gutman .
3,646,723 3/1972 Meroney .
3,660,959 5/1972 LaFleur .
3,669,347 6/1972 Platz et al. .
3,670,953 6/1972 Leventhal .
3,670,954 6/1972 Leventhal .
3,685,643 8/1972 Garshelis .
3,687,408 8/1972 Lake .
3,693,192 9/1972 Knotts .
3,694,524 9/1972 Tinger et al. .
3,737,129 6/1973 Foster .
3,739,977 6/1973 Shapiro et al. .
3,747,298 7/1973 Lieberman .
3,748,205 7/1973 Adams .
3,758,024 9/1973 Bethke et al. .
3,771,645 11/1973 Wendel .
3,782,073 1/1974 Musser .
3,797,732 3/1974 Melin et al. .
3,804,322 4/1974 Ericson .
3,853,664 12/1974 LaFleur .
3,857,329 12/1974 Lehmacher et al. .
3,865,235 2/1975 Levy et al. .
3,868,891 3/1975 Parish .
3,869,065 3/1975 Wang .
3,915,077 10/1975 LaFleur .
3,915,302 10/1975 Farrelly et al. .
3,946,443 3/1976 Knight .
3,966,524 6/1976 Lehmacher .
3,970,130 7/1976 Casey .
4,062,170 12/1977 Orem .
4,075,290 2/1978 Denzel et al. .
4,085,822 4/1978 Osborn .
4,106,734 8/1978 Walitalo .
4,118,802 10/1978 Polster .
4,120,716 10/1978 Bonet .
4,137,958 2/1979 Golby et al. .
4,147,827 4/1979 Breidt, Jr. et al. .
4,151,318 4/1979 Marshall .
4,164,170 8/1979 Nordin .
4,165,832 8/1979 Kuklies et al. .
4,175,602 11/1979 Cavalaris et al. .
4,198,260 4/1980 Mundus et al. .
4,205,021 5/1980 Morita et al. .
4,262,581 4/1981 Ferrell .
4,264,392 4/1981 Watt .
4,268,346 5/1981 Achelpohl .
4,305,558 12/1981 Baker .
4,313,229 2/1982 Villafañe .
4,316,353 2/1982 Suominen .
4,326,664 4/1982 Benoit et al. .
4,332,361 6/1982 McClellan .
4,340,379 7/1982 Williamson .
4,346,834 8/1982 Mazumdar .
4,365,716 12/1982 Watt .
4,367,841 1/1983 Mazumdar .
4,368,765 1/1983 Larkin et al. .
4,378,268 3/1983 Lehmacher .
4,388,924 6/1983 Weissman et al. .
4,390,096 6/1983 Goldenberg .
4,401,427 8/1983 Benoit et al. .
4,406,371 9/1983 Membrino .
4,407,474 10/1983 Swenson .
4,417,670 11/1983 Booher .
4,437,634 3/1984 Hambleton .
4,458,867 7/1984 Malik .
4,461,441 7/1984 Briggs .
4,464,157 8/1984 Beniot et al. .
4,476,979 10/1984 Reimann et al. .
4,480,750 11/1984 Dancy .
4,487,388 12/1984 Provan .
4,491,959 1/1985 Loefberg .
4,493,419 1/1985 Prader et al. .
4,508,222 4/1985 Choe .
4,526,639 7/1985 Reimann .
4,529,087 7/1985 Neal et al. .
4,529,090 7/1985 Pilon .
4,538,783 9/1985 Stobbe .
4,541,228 9/1985 Petersen .
4,554,192 11/1985 Benoit .
4,557,384 12/1985 Membrino .
4,560,067 12/1985 Reimann .
4,562,925 1/1986 Pistner .

4,571,235 2/1986 Benoit .
4,578,814 3/1986 Skamser .
4,581,007 4/1986 Kamp .
4,588,392 5/1986 Maddock .
4,597,103 6/1986 Hoover .
4,597,749 7/1986 O'Brien et al. .
4,604,084 8/1986 Pistner .
4,604,927 8/1986 Reimann .
4,613,988 9/1986 Maddock .
4,623,111 11/1986 Prader .
4,652,253 3/1987 Benoit .
4,655,737 4/1987 Benoit .
4,670,083 6/1987 Membrino .
4,676,284 6/1987 DeCrane .
4,676,378 6/1987 Baxley et al. .
4,699,608 10/1987 Pistner .
4,704,101 11/1987 Schirmer .
4,720,872 1/1988 Kaczerwaski .
4,735,602 4/1988 DeBin .
4,744,200 5/1988 Benoit, Jr. et al. .
4,759,742 * 7/1988 Achelpohl ..... 383/37 X
4,783,178 11/1988 Herder .
4,783,856 11/1988 Bouwens et al. .
4,785,938 11/1988 Benoit, Jr. et al. .
4,786,275 11/1988 Hoover .
4,790,437 * 12/1988 Pistner ..... 383/8 X
4,796,126 1/1989 Tsuchiya et al. .
4,796,759 1/1989 Schisler .
4,811,417 3/1989 Prince et al. .
4,812,055 3/1989 Prader et al. .
4,816,104 3/1989 Benoit .
4,819,806 4/1989 Pistner .
4,819,898 4/1989 Benoit et al. .
4,830,317 5/1989 Kober et al. .
4,840,610 6/1989 Pistner .
4,846,349 * 7/1989 Galimberti ..... 383/8 X
4,854,999 8/1989 Schirmer .
4,877,473 10/1989 Snowdon et al. .
4,883,450 11/1989 Benoit .
4,913,561 4/1990 Beer .
4,921,197 5/1990 Benoit et al. .
4,989,732 2/1991 Smith .
4,995,860 2/1991 Wilfong .
5,014,582 5/1991 Teik .
5,020,750 6/1991 Vrooman et al. .
5,062,927 11/1991 Stout .
5,087,234 2/1992 Prader et al. .
5,149,201 9/1992 Benoit .
5,183,158 2/1993 Boyd et al. .
5,219,220 6/1993 Kucera et al. .
5,333,730 8/1994 Boyd .
5,465,845 11/1995 Norby et al. .
5,484,376 1/1996 Prader et al. .
5,507,713 4/1996 Glod, Sr. et al. .
5,573,489 * 11/1996 Letendre et al. ..... 383/8 X
5,630,779 5/1997 Glod et al. .
5,669,504 9/1997 Leone et al. .
5,890,810 * 4/1999 Barlow ..... 383/8 X
6,089,753 * 7/2000 Belias et al. ..... 383/8

* cited by examiner

FOLDED THERMOPLASTIC BAG STRUCTURE

This application is a divisional of U.S. patent application Ser. No. 09/049,402, filed Mar. 27, 1998 now U.S. Pat. No. 6,059,707.

FIELD OF THE INVENTION

The present invention relates generally to the field of thermoplastic bags. More particularly, it concerns thermoplastic handle bags having a T-shirt configuration.

BACKGROUND OF THE INVENTION

For many years, thermoplastic bags have been widely used for a number of household and industrial purposes. Many bags have a simple rectangular structure comprising two layers of thermoplastic film heat sealed at the bag bottom, folded sides and an open top. This simple structure has been adapted to form a wide variety of sizes and configurations that vary with the intended uses of the bags.

In recent years, bag manufacturers have developed new types of thermoplastic bags such as, for example, draw tape bags, handle bags, and bags with protruding top edges. These different bag types provide the user with different advantages such as being able to easily close, tie and/or identify a bag. However, the easy to open, use and close handle bags have traditionally required expensive and complicated manufacturing procedures. Furthermore, handle bag manufacturers have experienced cost reduction pressure from other products and, as a result of their cost reduction efforts, new product configurations have been developed. These new handle bag configurations have decreased the manufacturing costs of the product but have also made the resulting bags more difficult to open and use.

For example, one existing low cost handle bag configuration is produced by starting with a thin thermoplastic film tube that is transversely heat sealed to form individual bags. The edges of tube are then longitudinally folded inward so that the edges are adjacent to the middle of the bag. The tube is then folded again about its middle thereby forming four overlapped bag sections comprising eight layers of thermoplastic material. A corner of the bag is then removed to form the handles and bag mouth. Such a manufacturing process is described and illustrated in U.S. Pat. No. 4,790,467.

However, the above described manufacturing process makes the resulting handle bag difficult and time consuming to use. A user must unfold the second middle fold and then the first quarter folds in sequence before being able to open the bag.

Consequently, these deficiencies have created a need for an inexpensive and efficient method of manufacturing handle bags that are easy to open, use and close.

SUMMARY OF THE INVENTION

In accordance with one aspect of the present invention, there is provided a low cost method of forming handle bags that are easy and less time consuming to open, use and close.

In accordance with another aspect of the present invention, there is provided a handle bag that is easy to open, use and close.

In accordance with yet another aspect of the present invention, there is provided a method that involves less folding than prior methods to form a handle bag.

These and other objects of the invention are provided by a method of forming a plurality of easy to open handle bags including the steps of providing a flattened tube of thermoplastic material oriented in a generally longitudinal direction. The flattened tube has a first longitudinal side edge and a second longitudinal side edge, a transverse lower heat seal, and a transverse upper heat seal. The tube also has first, second, and third sections. The second section being disposed between the first and third sections. The first section is joined to the second section along a generally longitudinal first fold line. The second section is joined to the third section along a generally longitudinal second fold line. The second section is cut along a generally transverse first cut line extending between the first and second fold lines. The first section is folded over the second section along the first fold line. The third section is folded over the previously folded-over first section along the second fold line such that the first, second, and third sections overlap one another. The overlapped first, second, and third sections are cut along a generally longitudinal second cut line that intersects the first cut line, the first fold line, and the second side edge at one end and intersects the upper heat seal at the other end. The overlapped first, second, and third sections are then cut along a generally longitudinal third cut line that intersects the first cut line, the second fold line, and the first side edge at one end and intersects the upper heat seal at the other end.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

FIG. 2*b* is a cross-sectional view taken along line 2*c*—2*c* in FIG. 2*a* showing how the collapsed tube is folded;

FIG. 3 is a perspective view of the tube of FIG. 1 being folded into the tube of FIG. 2*a.

DESCRIPTION OF ILLUSTRATIVE EMBODIMENTS

Figure 1:
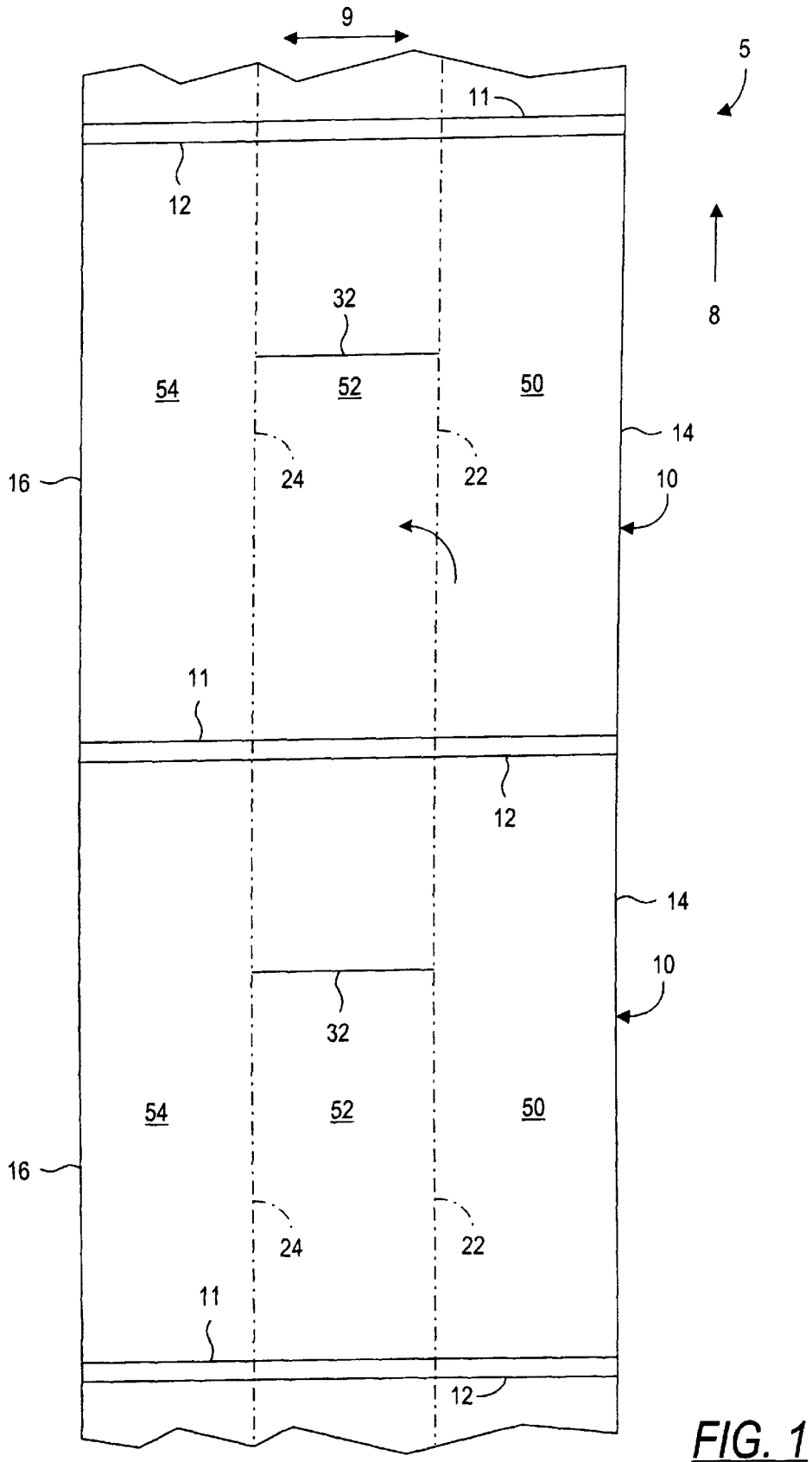
FIG. 1 is a plan view of a collapsed thermoplastic tube.

Referring now to the drawings, and more particularly to FIG. 1, there is shown a collapsed thermoplastic tube 5 traveling in a longitudinal direction 8. The collapsed tube 5 includes an opposing top and bottom layer of thermoplastic film. Each opposing layer may comprise one or more layers of thermoplastic material. The transverse direction 9 is generally perpendicular to the longitudinal direction 8 in which the thermoplastic tube 5 moves. The thermoplastic material used can be any thermoplastic material well known to one of ordinary skill in the art and as more specifically detailed herein below. The tube 5 includes a plurality of interconnected bag forming segments 10. Each bag forming segment 10 includes a pair of opposing longitudinal side edges 14 and 16. Adjacent bag forming segments 10 are separated from each other by transverse heat seals 11 and 12. Each bag forming segment 10 comprises a first, second and third section 50, 52 and 54, respectively. The second section 52 is disposed between the first section 50 and the third section 54. The first section 50 is joined to the second section 52 along a generally longitudinal first fold line 22. The second section 52 is joined to the third section 54 along a generally longitudinal second fold line 24.

The method of forming a plurality of interconnected handle bags begins by forming a transverse lower heat seal 11 and a transverse upper heat seal 12 for each bag forming segment 10. To form the heat seals 11 and 12, the tube 5 travels through a sealing station where pairs of transverse heat seals 11 and 12 are formed across the tube 5. The opposing thermoplastic layers of the tube 5 are thermally fused to each other along the heat seals 11 and 12 at about bag-length distances apart. Alternatively, one broad heat seal may replace the heat seals 11 and 12. This broad heat seal may then either be perforated or severed, as described below, to produce the same results described herein.

Figure 2A:
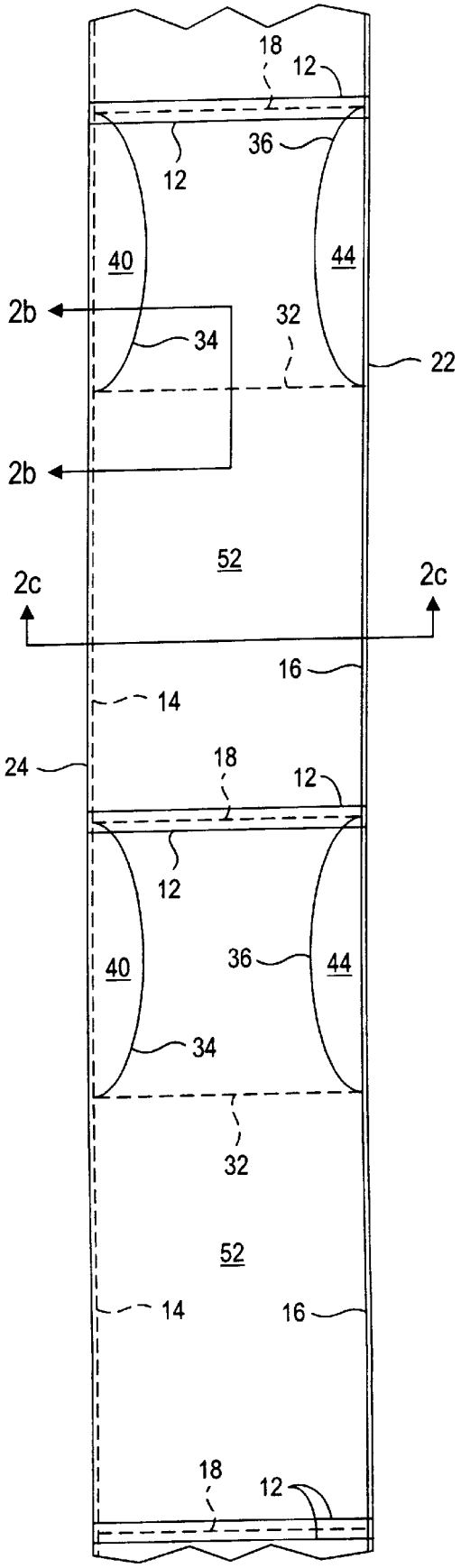
FIG. 2*a* is a plan view of the tube of FIG. 1 after it has been folded in thirds.

The method proceeds by cutting the second section 52 along a generally transverse first cut line 32 that extends between the first fold line 22 and the second fold line 24. The tube 5 is cut at a cutting station that includes a cutting instrument that operates to sever both layers of the tube 5 at cut line 32. Referring now to FIGS. 1 and 2*a,* the method continues by longitudinally folding the first section 50 over the second section 52 along the first fold line 22. Then, the third section 54 is folded over the folded-over first section 50 along the second fold line 24 such that the first, second, and third sections 50, 52 and 54, overlap one another and comprise a total of six layers of thermoplastic material.

Referring now to FIG. 2*a,* the bag forming segments 10 are weakened between the heat seals 11 and 12 at line of weakness 18. The transverse lines of weakness 18 are created between the upper heat seal 11 of one segment and the lower heat seal 12 of an adjacent segment to form separable bags and to facilitate removal of sections 40, 42 and 44, as described below. The lines of weakness 18 may be in the form of perforations, thinned lines, scored lines, etc.

Figure 2B:
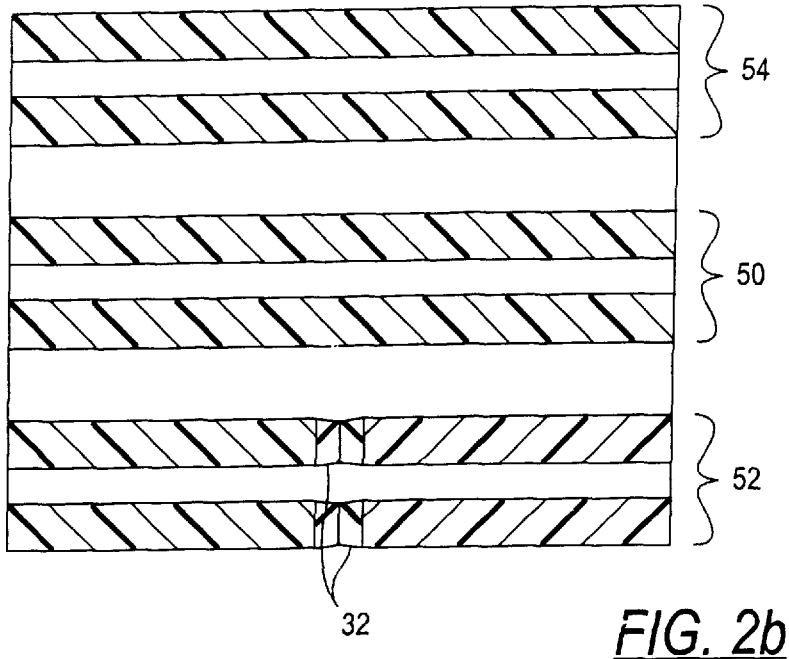
FIG. 2*b* is a cross-sectional view taken along line 2*b*—2*b* in FIG. 2*a* showing a portion of the collapsed tube and a transverse cut.
Figure 2C:
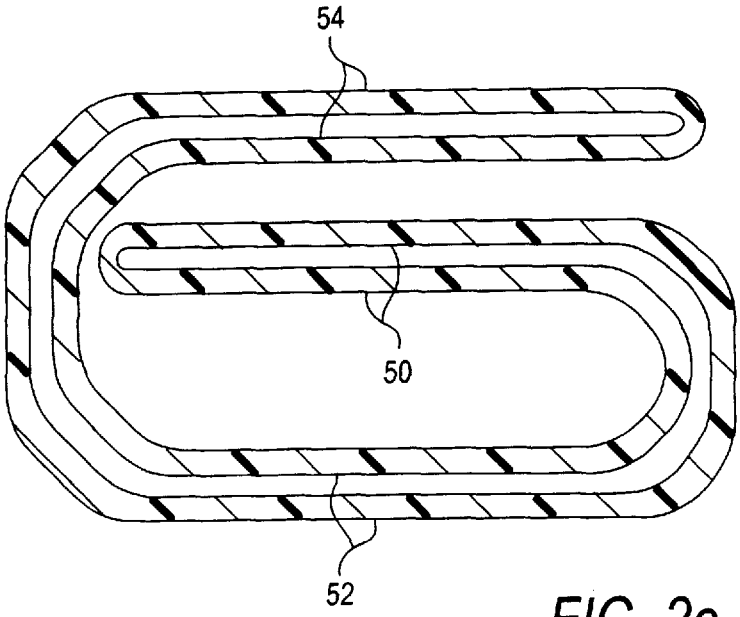

FIGS. 2*b* and 2*c* illustrate cross-sectional views of the tube 5. FIG. 2*b* illustrates sections 50, 52 and 54 and the transverse cut 32 while FIG. 2*c* illustrates how the tube 5 is folded.

Figure 3:
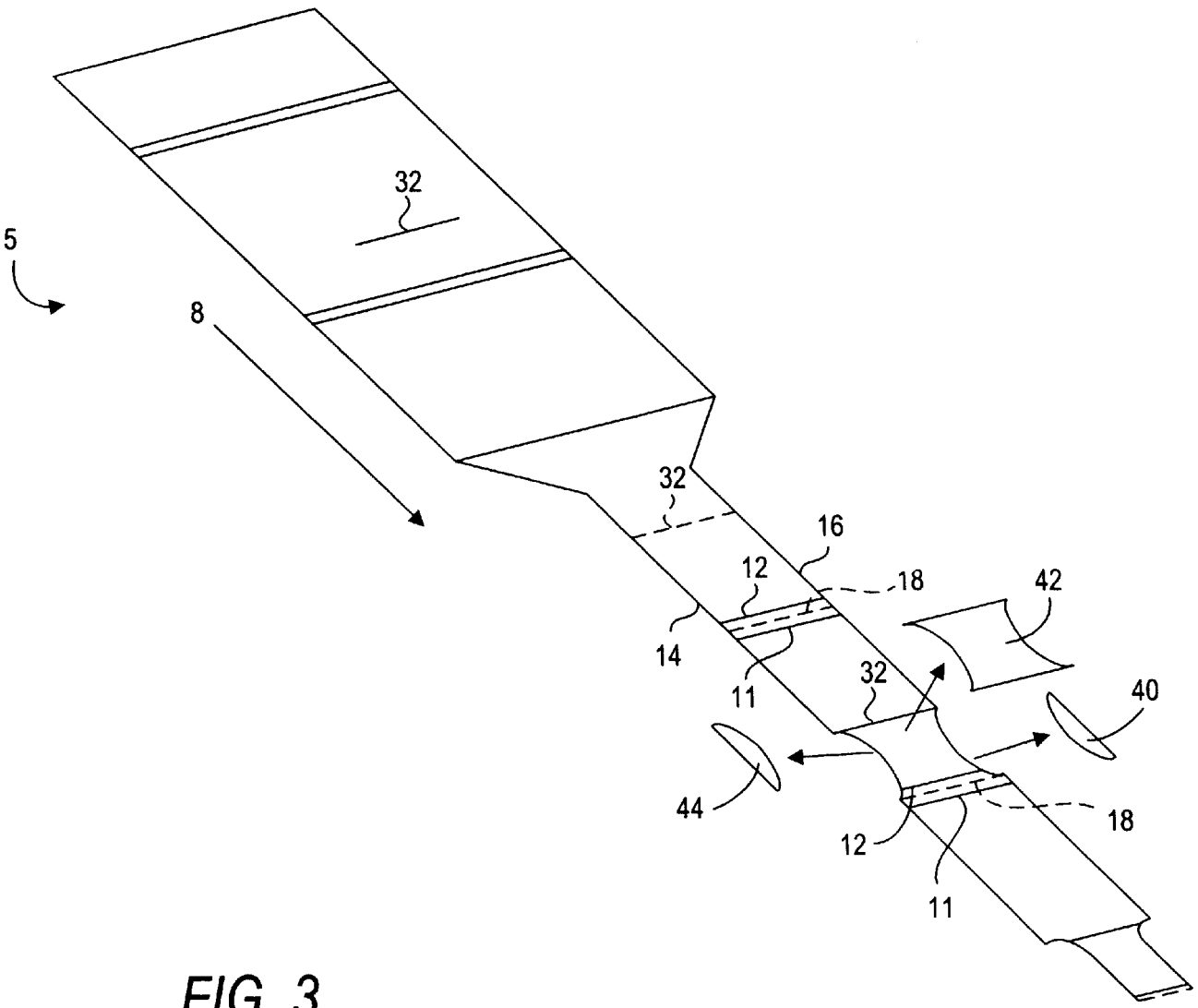
Figure 4:
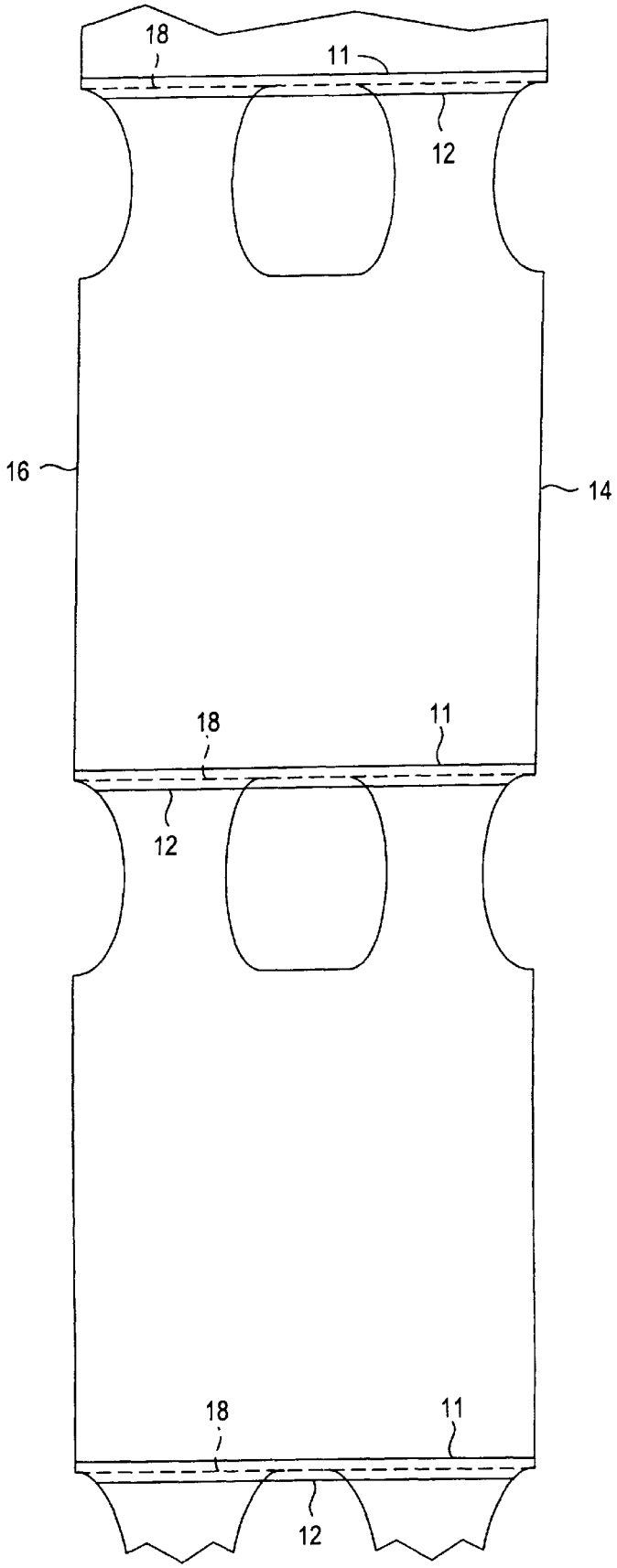
* and FIG. 4 is a plan view of the tube of FIG. 2*a* after it has been unfolded.

Referring now to FIGS. 2*a* and 3, a second cutting station cuts the overlapped first, second, and third sections 50, 52 and 54 along a generally longitudinal second cut line 36 that intersects the first cut line 32, the first fold line 22, and the second side edge 16 at one end and intersects the upper line of weakness 18 at the other end. Next, the second cutting station cuts the overlapped first, second, and third sections 50, 52 and 54 along a generally longitudinal third cut line 34 that intersects the first cut line 32, the second fold line 24, and the first side edge 14 at one end and intersects the upper line of weakness 18 at the other end. Sections 40, 42 and 44 are then removed, as illustrated in FIG. 3, to form a plurality of interconnected handle bags 10. Removed sections 40 and 44 include six layers of thermoplastic material. Removed section 42 includes only two layers of thermoplastic material corresponding to section 52 of the unfolded bag 10 illustrated in FIG. 1. Cut line 32 is shown in phantom in the bottom part of FIG. 3 because cut line 32 is in section 52 which is obstructed from this view by folded over sections 50 and 54. FIG. 4 illustrates the plurality of interconnected handle bags 10 after they are unfolded and laid flat.

Thus, the method of the present invention provides a plurality of longitudinally folded and interconnected handle bags 10. In one embodiment, the bags 10 are then wound onto a roll for packaging. In another embodiment, the bags 10 are severed into individual bags, folded transversely and stacked for packaging. In yet another embodiment, each bag 10 is first folded transversely and then severed from the interconnected bags and stacked for packaging. The above methods provide a handle bag that is easy to open, use and close thus saving the user time and preventing frustration.

The thermoplastic materials suitable for the present invention include high density and low density polyethylenes. Particularly preferred is linear low density polyethylene (LLDPE). LLDPE is an ethylenic copolymer formed by copolymerizing ethylene with a minor proportion by weight of an alpha olefin monomer containing 4 to 10 carbon atoms. The use of LLDPE in garbage bags has permitted manufacturers to increase strength, puncture resistance, and tear resistance properties. By way of example, and not intended to limit the scope of the present invention, typical film thicknesses used for bags of the present invention are from about 0.3 mil to about 1.5 mil.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A folded thermoplastic bag structure comprising:

a plurality of interconnected thermoplastic bag segments, each of the bag segments including a pair of thermoplastic layers, a first longitudinal side edge and a second longitudinal side edge, a transverse lower heat seal, a transverse upper heat seal, each of the bag segments including first, second, and third sections, the second section being disposed between the first and third sections, the first section being joined to the second section along a generally longitudinal first fold line, the second section being joined to the third section along a generally longitudinal second fold line;

the second section of each bag segment having a transverse cut along a generally transverse first cut line extending entirely between the first and second fold lines;

the first section of each bag segment being longitudinally folded over the second section along the first fold line;

the third section of each bag segment being longitudinally folded over the folded-over first section along the second fold line such that the first, second and third sections substantially overlap one another;

an upper line of weakness being disposed between the transverse upper heat seal of one segment and the transverse lower heat seal of an adjacent segment;

each of the bag segments having a generally longitudinal second cut line extending through the first, second, and third sections and intersecting the first cut line, the first fold line, and the second side edge at one end and intersecting the upper line of weakness at the other end;

each of the bag segments having a generally longitudinal third cut line extending through the first, second, and third sections and intersecting the first cut line, the second fold line, and the first side edge at one end and intersecting the upper line of weakness at the other end; and each of the bag segments having removable sections formed by the first, second and third cut lines.

2. The bag structure of claim 1, wherein the first cut line is generally linear.

3. The bag structure of claim 1, wherein the second cut line intersects both the upper heat seal and the first fold line at the other end, and wherein the third cut line intersects both the upper heat seal and the second fold line at the other end.

4. The bag structure of claim 3, wherein the second and third cut lines form respective parabolic, removable sections.

5. The bag structure of claim 4, wherein the removable sections comprise six layers of thermoplastic material.

6. The bag structure of claim 1, wherein the one end of the second cut line is located at an intersection of the first cut line and the first fold line and the other end of the second cut line is located at an intersection of the upper heat seal and the first fold line, and wherein the one end of the third cut line is located at an intersection of the first cut line and the second fold line and the other end of the third cut line is located at an intersection of the upper heat seal and the second fold line.

7. The bag structure of claim 1, wherein the one end of the second cut line is located at an intersection of the first cut line and the first fold line, and wherein the one end of the third cut line is located at an intersection of the first cut line and the second fold line.

8. The method of claim 1, wherein the first, second, and third sections are approximately equal in area.

9. The bag structure of claim 1, wherein the second and third cut lines are generally arc shaped.

10. The bag structure of claim 1, wherein the second and third cut lines create handles for the bag.

11. The bag structure of claim 10, wherein the first cut line creates an empty gap between the handles.

12. The bag structure of claim 11, wherein the empty gap is formed by the removal of two layers of thermoplastic material from the second section.

13. The bag structure of claim 1, wherein the second and third cut lines form two respective circle segments that are removable.

14. The bag structure of claim 1, wherein the tube is comprised of two opposing layers of thermoplastic material.

15. The bag structure of claim 1, wherein the first, second and third sections are each comprised of two layers of thermoplastic material.

16. The bag structure of claim 1, wherein the overlapped first, second and third sections comprise a total of six layers of thermoplastic material.

* * * * *